US007296616B2

(12) United States Patent
Bewlay et al.

(10) Patent No.: US 7,296,616 B2
(45) Date of Patent: Nov. 20, 2007

(54) SHELL MOLD FOR CASTING NIOBIUM-SILICIDE ALLOYS, AND RELATED COMPOSITIONS AND PROCESSES

(75) Inventors: Bernard Patrick Bewlay, Schenectady, NY (US); Laurent Cretegny, Niskayuna, NY (US); Michael Francis Xavier Gigliotti, Jr., Scotia, NY (US); Roger John Petterson, Guilderland, NY (US); Ann Melinda Ritter, Niskayuna, NY (US); Stephen Francis Rutkowski, Duanesburg, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 11/020,519

(22) Filed: Dec. 22, 2004

(65) Prior Publication Data

US 2006/0130996 A1 Jun. 22, 2006

(51) Int. Cl.
*B22C 1/00* (2006.01)

(52) U.S. Cl. ..... 164/519; 164/517

(58) Field of Classification Search ..... 164/519, 164/517

See application file for complete search history.

(56) References Cited

U.S. PATENT DOCUMENTS 3,955,616 A 5/1976 Gigliotti, Jr. et al.
3,972,367 A 8/1976 Gigliotti, Jr. et al.
4,141,781 A 2/1979 Greskovich et al.
4,247,333 A 1/1981 Ledder et al.
4,664,172 A * 5/1987 Takayanagi ..... 164/34
4,703,806 A 11/1987 Lassow et al.
4,947,927 A 8/1990 Horton
4,966,225 A 10/1990 Johnson et al.
5,143,777 A 9/1992 Mills
6,500,283 B1 12/2002 Schaeffer et al.
6,676,381 B2 * 1/2004 Subramanian et al. .. 416/241 B
6,759,151 B1 7/2004 Lee
2003/0190235 A1 * 10/2003 Subramanian et al. .. 416/241 B

* cited by examiner

*Primary Examiner*—Kuang Y. Lin
(74) *Attorney, Agent, or Firm*—Francis T. Coppa; Patrick K. Patnode

(57) ABSTRACT

A shell mold for casting molten material to form an article is described. The mold includes a shell for containing the molten material, formed from at least one of yttrium silicates, zirconium silicates, hafnium silicates, and rare earth silicates. The mold also includes a facecoat disposed on an inner surface of the shell that contacts the molten material. The facecoat can be made from the materials described above. A method of casting a niobium-silicide article is also described, using the shell mold described herein. A method of making the ceramic shell mold is described as well, along with a slurry composition used in the manufacture of the shell mold.

24 Claims, 1 Drawing Sheet

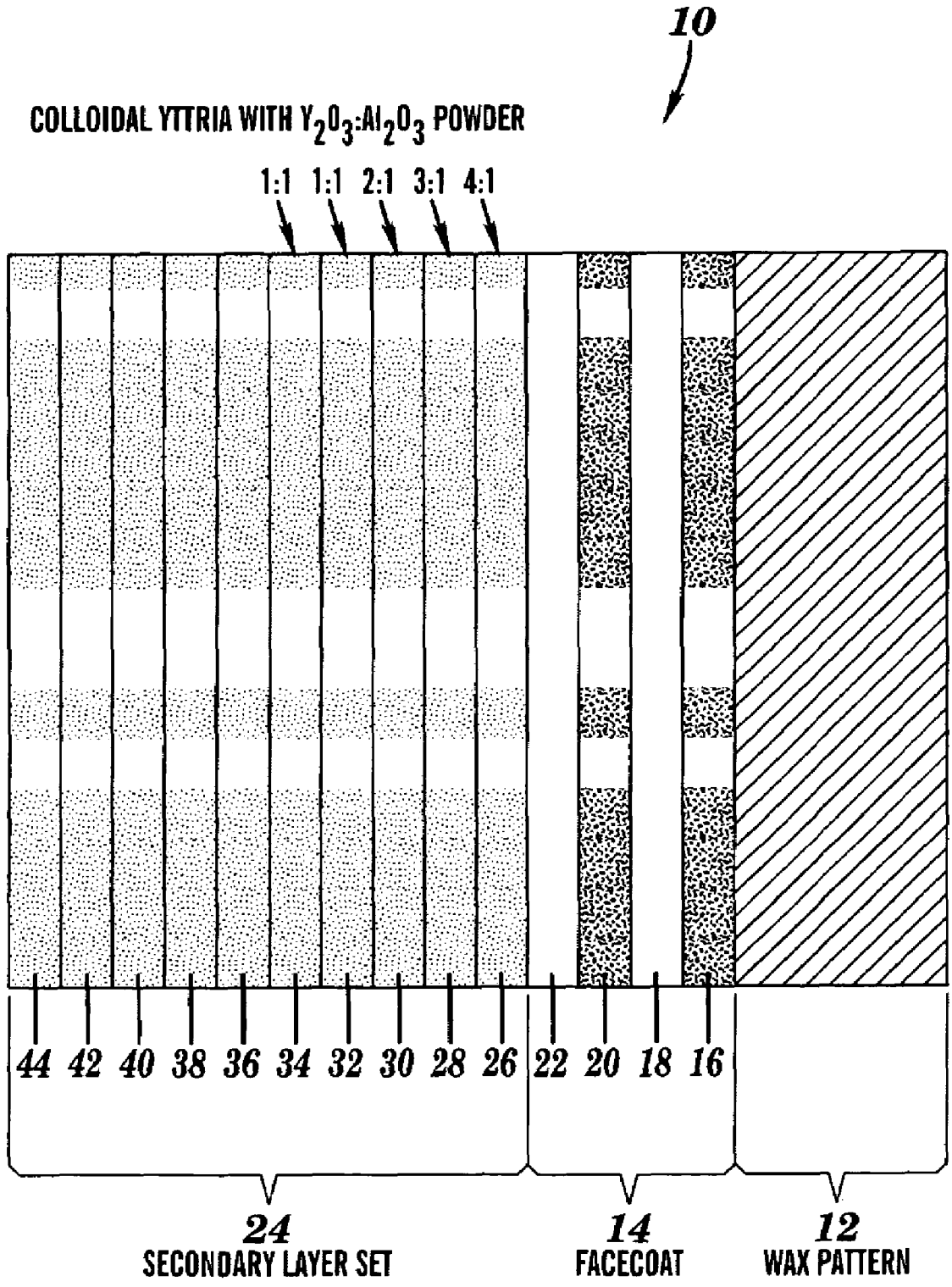
10
COLLOIDAL YTTRIA WITH $Y_2O_3$:$Al_2O_3$ POWDER
1:1 1:1 2:1 3:1 4:1
44 42 40 38 36 34 32 30 28 26 22 20 18 16
24
SECONDARY LAYER SET
14
FACECOAT
12
WAX PATTERN

SHELL MOLD FOR CASTING NIOBIUM-SILICIDE ALLOYS, AND RELATED COMPOSITIONS AND PROCESSES

BACKGROUND OF THE INVENTION

This invention relates generally to the investment casting of metals and alloys that contain metal silicides. More specifically, it relates to the investment casting of niobium-silicides in shell molds.

Many different types of metals and metal alloys are especially useful for high temperature equipment, e.g., engines and other machinery. As one example, superalloys have been the materials of choice for turbine engine components, such as turbine buckets, nozzles, blades, and rotors. The superalloys are often based on nickel, although some are based on cobalt, or combinations of nickel and cobalt. These materials provide the chemical and physical properties required for turbine operating conditions, i.e., high temperature, high stress, and high pressure. As an illustration, an airfoil for a modern jet engine can reach temperatures as high as about 1100° C., which is about 80-85% of the melting temperature of most nickel-based superalloys.

While nickel-based superalloys continue to be tremendously popular, research efforts in recent years have also focused on alternative materials for high temperature components, such as the turbine engines. Refractory metal intermetallic composite (RMIC) materials are a prime illustration. Examples include various niobium-silicon alloys (sometimes referred to as "niobium-silicides"). (The RMIC materials may also include a variety of other elements, such as titanium, hafnium, aluminum, and chromium). Such materials generally have much greater temperature capabilities than the current class of superalloys. The melting point for a metal charge based on the RMIC materials will of course depend on the individual constituents of the RMIC, but is usually in the range of about 1500° C. to about 2100° C.

RMIC materials, as well as the superalloys, are cast into useful articles by various techniques. One of the most popular techniques is investment casting, sometimes referred to as the "lost wax process". Typically, the process involves dipping a wax model into a slurry comprising a binder and a refractory material, so as to coat the model with a layer of slurry. The binder is often a silica-based material. Colloidal silica is very popular for this purpose, and is widely used for investment-casting molds. Commercially available colloidal silica grades of this type often have a silica content of approximately 10%-50%.

Typically, a stucco coating of dry refractory material is then applied to the surface of the slurry layer. The resulting stucco-containing slurry layer is allowed to dry. Additional stucco-slurry layers are applied as appropriate, to create a shell mold around the wax model having a suitable thickness. After thorough drying, the wax model is eliminated from the shell mold, and the mold is fired.

The ceramic shell molds used during investment-casting must exhibit a number of important attributes. For example, the strength and integrity of the mold are very important factors in ensuring that the metal part formed in the mold has the proper dimensions. These attributes are especially critical for manufacturing high performance components, such as superalloy parts used in the aerospace industry.

The shell molds described above are very suitable for casting in many situations. However, considerable drawbacks are sometimes present. For example, free silica in the shell mold tends to limit the casting temperature and the materials which can be successfully cast. Other problems are present when the shell mold is used to cast chemically-reactive materials like the niobium-silicides. As an illustration, silica in the wall of the shell mold can react with the niobium-silicide material, resulting in serious surface defects in the cast article. Precision casting is limited because of the defective surfaces. In some cases, over-size parts must be cast and then machined-to-size in order to remove the surface defects.

Facecoats are sometimes used to form a protective barrier between the molten casting metal and the surface of the shell mold. For example, U.S. Pat. No. 6,676,381 (Subramanian et al) describes a facecoat based on yttria or at least one rare earth metal and other inorganic components, such as oxides, silicides, silicates, and sulfides. The facecoat compositions are most often in the form of a slurry which includes a binder material, along with a refractory material like the yttria component. When a molten, reactive casting metal is delivered into the shell mold, the facecoat prevents the undesirable reaction between the casting metal and the walls of the mold, i.e., the walls underneath the facecoat. Facecoats can sometimes be used, for the same purpose, to protect the portion of a core (within the shell mold) which would normally come into contact with the casting metal.

Yttria is a very desirable component for the facecoat slurries, because of its refractory-nature, and chemical inertness. In fact, yttria-based slurries have been evaluated to some degree in the past, as described in U.S. Pat. No. 4,947,927 (Horton). Unfortunately, there are serious problems associated with yttria slurries of this type, in regard to both the facecoat and the remainder of the shell mold structure. The slurries are chemically and thermally unstable, making them difficult to store and use. They can also be expensive to prepare. Furthermore, as described in the Horton patent, the use of yttria-based slurries can lead to a facecoat surface which has considerable imperfections, such as pores and pits.

It should thus be apparent that improved shell molds which can accommodate high-temperature materials like the niobium-silicides would be welcome in the art. The shell molds should have refractory surfaces (e.g., in the form of facecoats) which are relatively inert to the high temperature materials being cast. Moreover, the shell molds should be capable of being prepared economically from slurries, using an investment casting process. The shell molds should also be capable of accommodating pre-fabricated cores which are fully compatible with materials like the niobium-silicides. Furthermore, it would also be very advantageous if the physical properties of the walls of the shell mold could be adjusted throughout their thickness, e.g., in terms of wall strength and thermal expansion characteristics.

BRIEF DESCRIPTION OF THE INVENTION

One embodiment of this invention is directed to a shell mold for casting molten material to form an article. The mold comprises:

(a) a shell for containing the molten material, comprising at least one compound selected from the group consisting of yttrium silicates, zirconium silicates, hafnium silicates, rare earth silicates, and combinations thereof; and (b) a facecoat disposed on an inner surface of the shell that contacts the molten material, said facecoat comprising at least one compound selected from the group consisting of yttrium silicates, zirconium silicates, hafnium silicates, rare earth silicates, and combinations thereof.

Another embodiment of the invention relates to a method of casting a niobium-silicide article. The method comprises the step of introducing molten niobium-silicide into a cavity of a shell mold, and then allowing the molten material to cool and solidify. The shell mold employed in this method is mentioned above, and further described in the remainder of the specification.

An additional embodiment is directed to a method of making a ceramic shell mold for casting niobium-silicide-based articles. This method includes the steps of:

(i) applying a facecoat-forming material to a wax pattern which has a configuration corresponding to a desired mold cavity, so as to form a facecoat, wherein the facecoat-forming material comprises at least one compound selected from the group consisting of yttrium silicates, zirconium silicates, hafnium silicates, rare earth silicates, and combinations thereof;

(ii) applying at least one aqueous slurry over the facecoat in successive layers until a mold having a mold wall of a desired thickness is obtained, wherein the aqueous slurry comprises colloidal silica and at least one compound selected from the group consisting of yttrium silicates, zirconium silicates, hafnium silicates, rare earth silicates, and combinations thereof; and then (iii) heat-treating the mold to remove substantially all free silica. At least a substantial portion of the silica is removed, via conversion to one or more silicates, as described below.

Still another embodiment of the invention embraces a slurry composition. The slurry is used to provide the components of a shell mold structure in an investment casting process. The slurry comprises water, silica, and at least one of free yttria, yttrium monosilicate, or a combination of free yttria and yttrium monosilicate. As used herein, "free yttria" is meant to describe yttria which is not chemically bonded to any other species, e.g., to a metal to form a silicate.

BRIEF DESCRIPTION OF THE DRAWINGS

FIG. 1 is a cross-sectional depiction of a shell mold used for investment casting in embodiments described herein.

DETAILED DESCRIPTION OF THE INVENTION

In one embodiment of the present invention, a niobium-silicide material (alloy) is first introduced into a cavity of a shell mold for casting. Suitable niobium-silicide alloys are described in the following patents, which are all incorporated herein by reference: U.S. Pat. No. 5,833,773 (Bewlay et al); U.S. Pat. No. 5,932,033 (Jackson et al); U.S. Pat. No. 6,419,765 (Jackson et al); and U.S. Pat. No. 6,676,381 (Subramanian et al).

The niobium-silicide alloys usually have a microstructure comprising a metallic Nb-base phase and an intermetallic metal silicide phase (e.g., Nb-silicide). However, they may include one or more other phases as well. The metallic Nb-phase is relatively ductile, while the intermetallic silicide phase is more brittle and stronger. These alloys may be considered to be a composite of a ductile metallic phase and a brittle strengthening phase, wherein the composite is formed in-situ upon solidification of the alloy. (As used herein, "alloy" is meant to describe a solid or liquid mixture of two or more metals, or one or more metals with one or more non-metallic elements).

In some preferred embodiments, the niobium-silicide alloys include nitrogen (N). The presence of nitrogen can improve the high temperature- and/or low temperature properties of the resulting alloys. Nitrogen-containing alloys of this type are described in pending application Ser. No. 10/932,128 (RD-27,311-1), filed on Sep. 1, 2004 for B. Bewlay et al, and incorporated herein by reference. Many of these compositions comprise about 1 atom % to about 25 atom % Si, and about 0.005 atom % to about 10 atom % N (and all sub-ranges therebetween), with the balance Nb. A more preferred range for the nitrogen component is usually about 0.005 atom % to about 5 atom %, with an especially preferred range being about 0.005 atom % to about 2 atom %. (Ser. No. 10/932,128 also describes methods and apparatuses for introducing nitrogen into a molten niobium-silicide composition). In some preferred embodiments, both the Nb-base phase and the metal silicide phase mentioned above are alloyed with N.

The niobium-silicide alloys may further comprise at least one element selected from the group consisting of titanium (Ti), hafnium (Hf), chromium (Cr), and aluminum (Al). Ti and/or Hf are often preferred constituents. A typical range for Ti is about 2 atom % to about 30 atom % (based on total atom % for the alloy material), and preferably, about 12 atom % to about 25 atom %. A typical range for Hf is about 0.5 atom % to about 12 atom %, and preferably, about 2 atom % to about 8 atom %. A typical range for Cr is about 0.1 atom % to about 20 atom %, and preferably, about 2 atom % to about 8 atom %. A typical range for Al is about 0.1 atom % to about 15 atom %, and preferably, about 0.1 atom % to about 4 atom %.

The niobium-silicide alloys may also comprise additional elements. Non-limiting examples are molybdenum, yttrium, tantalum, zirconium, iron, tungsten, and tin. The particular inclusion and amount for any of these elements will of course depend on a variety of factors, such as the desired properties for the final alloy product.

The composition of the metal silicide phase within the niobium-silicide alloy can vary significantly, as described in application Ser. No. 10/932,128. In some embodiments, the metal silicide phase comprises an $M_3Si$ silicide, where M is selected from the group consisting of Nb, Ti, and Hf. In other embodiments, the metal silicide phase comprises an $M_5Si_3$ silicide, where M is as described above. The microstructure of the alloy may contain other phases as well. One non-limiting example is based on a composite of Nb and $Nb_5Si_3$.

The shell mold used for casting niobium-silicide alloys according to this invention is formed of a material comprising at least one compound selected from the group consisting of yttrium silicates, zirconium silicates (e.g., $ZrSiO_4$ or $ZrO_2.SiO_2$), hafnium silicates (e.g., $HfSiO_4$), and rare earth-silicates. Some of the useful silicates have the following formulae (or combinations thereof):

$$R_2O_3.SiO_2; \quad \text{(i)}$$

$$2R_2O_3.3SiO_2; \text{ or} \quad \text{(ii)}$$

$$R_2O_3.2SiO_2, \quad \text{(iii)}$$

wherein R is yttrium or at least one rare earth element.

It should be emphasized that many different combinations of the compounds generally referenced above are possible. For example, mixtures comprising one or more of each type of silicate could be employed, as well as mixtures of the different metal silicates, e.g., mixtures of one or more yttrium silicates with a zirconium silicate and/or a hafnium silicate. Moreover, those skilled in the art understand that the oxygen content of the various silicates covered by the formulae listed above can vary significantly, while the crystal structure of the compound remains the same. Those variations are considered to be within the scope of this invention.

The rare earth metals are as follows: lanthanum, cerium, praseodymium, neodymium, promethium, samarium, europium, gadolinium, terbium, dysprosium, holmium, erbium, thulium, ytterbium, lutetium. Rare earth silicates are known in the art and described, for example, in U.S. Pat. No. 6,759,151 (Lee), which is incorporated herein by reference. The preferred rare earth metals for some embodiments are dysprosium, erbium, and ytterbium.

In some preferred embodiments, the shell mold comprises a material selected from the group consisting of yttria (yttrium oxide), at least one yttrium silicate, and a combination of yttria and at least one yttrium silicate. The preferred yttrium silicate for some embodiments is yttrium monosilicate (known as $Y_2SiO_5$ or $Y_2O_3.SiO_2$), due in part to its excellent refractory characteristics.

Yttria is widely available, and compounds like yttrium monosilicate are also commercially available. The latter material can also be prepared by conventional methods. Moreover, the yttrium silicate can be prepared, in situ, when a slurry containing yttria and colloidal silica is used to form the mold. The shell mold composition may further comprise reaction products formed when the shell mold is heat-treated, as described below.

In other embodiments, the shell mold material comprises at least one yttrium silicate, or a combination of at least one yttrium silicate and yttria, along with at least one of hafnium silicate and zirconium silicate. The hafnium- and zirconium silicates enhance the refractory characteristics of the completed shell mold. These shell mold materials usually comprise at least about 50% by weight of yttrium-containing compounds. A non-limiting, exemplary composition for these embodiments comprises: about 50% by weight to about 90% by weight yttrium monosilicate; about 1% by weight to about 10% by weight hafnium silicate; about 1% by weight to about 10% by weight zirconium silicate; and reaction products thereof.

The shell mold further comprises a protective layer or facecoat. Those skilled in the art are familiar with facecoats, which are disposed on an inner surface of the shell. (U.S. Pat. No. 6,676,381 of Subramanian et al is instructive in this regard). The facecoat is often a material which is similar or identical to the shell material, and can be formed from the same base material, e.g., the same slurry, or a similar slurry. Thus, the facecoat often comprises at least one compound selected from the group consisting of yttrium silicates, zirconium silicates, hafnium silicates, and rare earth-silicates (like those described previously), as well as reaction products formed when the facecoat is heat-treated.

Moreover, in other preferred embodiments, both the facecoat and the shell comprise yttrium monosilicate. These components of the shell mold may further include free yttria. In especially preferred embodiments, both the facecoat and the shell comprise at least about 50% by weight to about 99% by weight total yttria (free, or in silicate-form), based on the total weight of the shell mold. The use of substantial amounts of yttria in the shell mold provides a high degree of refractory character to the mold structure, which can be a critical attribute when casting the high-melting niobium-silicide alloys. Moreover, the substantial amount of yttria in the facecoat provides the chemical inertness necessary to prevent adverse reaction between the niobium-silicide and the shell mold walls.

In most preferred embodiments, the shell mold is substantially free of non-bonded silica. As mentioned previously, the presence of non-bonded silica ("free silica") can limit casting temperature, as well as causing adverse reaction between the niobium-silicide and the shell mold itself. The free silica is eliminated by heat treatment of the shell mold after its formation, as described below. The heat treatment usually converts substantially all free silica to silicate form e.g., to one or more yttrium silicate compounds which constitute part of the shell mold structure. This conversion step minimizes the problems associated with free silica.

The shell mold may further include one or more cores. As those skilled in the art understand, the cores are incorporated into shell molds to provide holes or cavities within the final part. The cores for the present invention may be formed by various methods, such as pressing or injection molding. Exemplary core materials are yttria, yttrium silicates, zirconium silicates, hafnium silicates, rare earth silicates, vitreous silica, alumina, aluminates, and various combinations thereof. The core material is later removed from the final casting by conventional techniques. Many references describe the use of cores, e.g., "Modern Metalworking; Casting and Forming Processes in Manufacturing"; and U.S. Pat. Nos. 5,014,763; 4,141,781; 4,097,292; and 4,086,311, which are incorporated herein by reference.

In one embodiment according to an investment casting process, a facecoat is applied over the surface of the core, prior to applying wax around the core. The facecoat usually comprises at least one of the materials discussed previously, for the mold shell, such as yttrium silicates, zirconium silicates, hafnium silicates, and rare earth-silicates, with the preferences noted above. After the facecoat has been applied to the core, e.g., by dipping, the core is usually pre-fired, to enhance the bonding of the facecoat to the surface of the core. The wax-deposition process is then carried out. (The core could also be subjected to a high-temperature heat treatment at this time, to remove free silica. However, the high-temperature heat treatment can be effected afterward, e.g., when the shell mold itself, containing the core, is heat-treated, as described below).

Some of the steps for making ceramic shell molds for this invention follow conventional techniques practiced in the art. Exemplary references include U.S. Pat. No. 4,947,927 (Horton); U.S. Pat. No. 4,703,806 (Lassow et al); U.S. Pat. No. 4,247,333 (Ledder); and U.S. Pat. No. 3,955,616 (Gigliotti, Jr. et al), all incorporated herein by reference. In preferred embodiments, a slurry is initially formed. The slurry is formed from base materials and/or precursors which react to form at least one compound selected from the group consisting of yttrium silicates, zirconium silicates, hafnium silicates, and rare earth silicates. In preferred embodiments, the slurry is initially prepared with a mixture comprising some form of silica and some form of the metal corresponding to the desired silicate.

The silica is preferably in the form of colloidal silica. Colloidal silica materials are commercially available from many sources, such as Nalco Chemical Company and Dupont. Non-limiting examples of such products are described by Horton in U.S. Pat. No. 4,947,927. The colloidal solution is usually diluted with de-ionized water, to vary the silica content. The slurries usually contain other additives, such as wetting agents, which ensure proper wetting of the wax pattern. Defoaming agents and viscosity-control agents are also typically included. Moreover, the slurries are preferably maintained at a pH high enough to maintain stability. Various techniques can be used for this purpose, e.g., the addition of metal hydroxides or organic hydroxides, as described in the Horton patent.

As mentioned above, the slurry further contains at least one metal selected from the group consisting of yttrium, zirconium, hafnium, and a rare earth compound. (The metals are typically employed in the form of oxides, such as yttria). Choice of a particular metal will of course depend on the desired shell mold composition. In some preferred embodiments, the metal is yttrium, zirconium, hafnium, or some combination thereof. In some highly preferred embodiments—especially when the shell mold is used to cast niobium-silicide alloys—the metal is yttrium. In that instance, the slurry often comprises free yttria, yttrium silicate, or a combination of free yttria and yttrium silicate.

The amount of metal (e.g., metal oxide) in the slurry will depend on various factors. They include: the identity of the metal; the shell mold requirements for casting; the type of material being cast; the casting temperature; the composition of the binder; and the overall process conditions employed. In general, the amount of metal oxide present ranges from about 50% by weight to about 95% by weight, based on the weight-fraction of solids for the slurry, i.e., excluding water and other volatile components. In the case of yttria, the level preferably ranges from about 80% by weight to about 95% by weight.

The slurries described herein are prepared by standard techniques, e.g., using conventional mixing equipment. For example, they can be prepared by mixing the aqueous-based binder, such as colloidal silica, with the metal or metal oxide (such as yttria, zirconia, or hafnia), and other desired additives, e.g., one or more compounds to maintain the pH at a desired level, as mentioned above.

In some preferred embodiments, the slurry, as-formed and ready for use, comprises a yttria-based aqueous binder. As used herein, "yttria-based" refers to binder compositions which comprise at least about 40% by weight yttrium metal, based on solids-weight in the slurry. In preferred embodiments, the slurries comprise at least about 70% by weight yttrium, and in some especially preferred embodiments, they comprise at least about 80% by weight yttrium. In the as-formed slurry, the level of silica is relatively small, e.g., usually less than about 20% by weight silica, based on solids-weight in the slurry. In preferred embodiments, the silica is present at less than about 10% by weight, and in some especially preferred embodiments, at less than about 5% by weight.

Various alternatives to a single, yttria-based slurry are possible. As one illustration, two separate slurries could be employed, collectively containing the mold-forming material. For example, one slurry might comprise a silica colloid, formed with fine silica particles, e.g., those having an average particle size of less than about 50 nanometers. The other slurry might comprise a yttria colloid, formed with fine yttria particles, e.g., those having an average particle size less than about 150 nanometers. (Other additives, such as defoaming agents, could be incorporated into one or both of the slurries). The slurries could be mixed together (with a pH adjustment for stability, if needed), and the resulting combination could be used as the source-material for facecoat- and/or mold wall formation.

There may be several advantages associated with the use of two slurries of this type. For example, controlled mixing of the yttria slurry with the silica slurry may enhance the stability of the yttria slurry (which can otherwise be difficult to stabilize sometimes). Moreover, the use of the very fine particles of yttria and silica for the shell mold may result in better green strength when the mold is fired.

In a typical embodiment for making the ceramic shell molds of this invention, a wax pattern having a shape and configuration corresponding to a desired mold cavity is dipped into the slurry. The wet coating of slurry is then at least partially dried, to form a covering over the wax pattern. This covering serves as the first layer of the facecoat. The pattern is then repetitively dipped into the slurry, to build up the facecoat to a desired thickness.

In some embodiments, the facecoat comprises layers with varying composition or particle size. For example, one layer could be formed of one silicate material such as yttrium silicate, while an adjacent layer might be formed from zirconium silicate or hafnium silicate. Furthermore, one or more layers may comprise fine particle size materials, while one or more layers may comprise coarse particles, e.g., those having an average particle size of greater than about 50 microns, and sometimes, greater than about 100 microns.

As a non-limiting example, the facecoat could comprise alternating layers of a material selected from the group consisting of free yttria, yttrium monosilicate, or a combination of free yttria and yttrium monosilicate. A first layer may comprise fine particles, e.g., less than about 50 about microns, while a second layer would comprise coarser particles, e.g., a stucco of particles having a size greater than about 100 microns. The layers (usually, about 2 to 8 for the facecoat) could continue to alternate. The presence of the stucco layers is helpful in providing greater strength to the mold when such an attribute is required.

The overall thickness of the facecoat will depend on various factors. They include the particular composition of the facecoat material, as well as the metal being cast in the completed mold. Usually, the facecoat has a thickness (after the mold is fired) of about 0.05 mm to about 2 mm.

In some embodiments, the facecoat is heat-treated after its formation. The heat treatment removes substantially all free silica from the facecoat, thereby providing some of the important advantages described herein. The heat treatment conditions can vary somewhat, and depend in part on the facecoat thickness and composition. In the case of a facecoat composition which primarily contains yttria and/or yttrium silicate, the heat treatment is often carried out at a temperature in the range of about 1100° C. to about 1500° C., for about 5 minutes to about 10 hours. In preferred embodiments, the treatment regimen involves a temperature in the range of about 1200° C. to about 1400° C., for about 1 hour to about 6 hours. The most appropriate heat treatment in the case of other facecoat compositions can be determined without undue experimentation. For example, the effect of a selected trial heat treatment can be ascertained by measuring the amount of free silica present (and/or the amount of metal silicate-formation), using common analytical techniques such as X-Ray diffraction; microscopy; and microchemical analysis. The heat treatment can be carried out in air or vacuum, or in an inert atmosphere, such as argon.

After formation of the facecoat (and after the optional heat treatment described above), additional material is deposited on the wax pattern, to build up the mold walls. In a typical embodiment, the wax pattern is dipped in either the same facecoat slurry, or a different slurry, or alternating combinations of multiple slurries. In preferred embodiments, at least one of the slurries is similar or identical to the slurry used for the facecoat material. In other words, the slurry is one which will result in a shell wall material selected from the group consisting of yttrium silicates, zirconium silicates, hafnium silicates, rare earth silicates, and combinations thereof. As in the case of the facecoat, the preferred shell wall material comprises yttrium silicate, free yttria, or a combination of yttrium silicate and free yttria.

In some embodiments, the shell wall is formed by applying a slurry layer of a desired silicate or silica/yttria material, followed by applying a layer of a stucco aggregate. This sequence is repeated a number of times, forming a set of secondary layers over the facecoat. (The main portion of the shell mold is formed by these secondary layers). The stucco aggregate could comprise a number of different materials—usually in the form of coarse particles having an average size of greater than about 50 microns. For example, the stucco material could comprise coarse particles of yttria or yttrium monosilicate (or a combination thereof).

Alternatively, the stucco material could comprise an alumina-based composition. Such materials are known in the art and described, for example, in U.S. Pat. No. 4,247,333 (Ledder et al) and U.S. Pat. No. 6,352,101 (Ghosh et al), which are incorporated herein by reference. A commercially available material such as fused alumina, tabular alumina, or sintered alumina silicates, is often used, as described in the Ledder patent, and in U.S. Pat. No. 5,143,777 (Mills). Moreover, mixtures of alumina having two or more particle sizes ("flour sizes") can also be used.

The number of layers (i.e., secondary layers) applied over the facecoat will of course depend on the desired thickness of the shell mold. As a non-limiting example, about 4 to about 20 total slurry layer/stucco layer pairs are often used for the secondary layers. A typical shell mold, once fired, has a total wall thickness (i.e., from the inner wall to the outer wall, and including the facecoat) of about 0.25 cm to about 2.50 cm, and preferably, about 0.50 cm to about 1.0 cm.

In some embodiments, the secondary layer set can comprise yttria, or one of the other metal oxides described above, along with an alumina-containing material such as alumina itself, according to a desired pattern or sequence. In other embodiments, the secondary layer set can comprise silica—in lieu of, or in addition to, the alumina-containing material. (The secondary layers may also comprise reaction products of the various components, e.g., mullite-type materials which are sometimes formed when alumina and silica react together).

The secondary layer set can be compositionally graded, so that properties are varied across the thickness of the shell mold wall. As a non-limiting illustration when using yttria and alumina, the total, relative amount of yttria could be decreased in some or all successive layers which are situated farther away from the facecoat. Simultaneously, the total, relative amount of alumina in some or all of the successive layers could be increased. The ratio of yttria to alumina in the first layer might be 4:1 by weight, for example, and then progress to 3:1, 2:1, and 1:1 in successive layers. In this manner, the strength of the mold can be increased, while reducing expenses associated with a higher-cost material like yttria.

Other physical properties can also be adjusted by way of this compositional grading. For example, the proportionate increase in alumina concentration can be very beneficial when greater high temperature-creep resistance is desired. The outermost layers of the mold can continue to vary in terms of the yttria/alumina ratio, or could stay at a set ratio, such as 1:1. In some preferred embodiments prompted by rigorous requirements for high-temperature mold stability, the secondary layers (e.g., about 2 to about 4 of them) farthest away from the facecoat may comprise at least about {90%} by weight alumina, and preferably, may comprise substantially all alumina). Usually, the variation in layer composition is accomplished by the use of multiple slurries containing the desired ingredients for a given layer.

FIG. 1 provides a general, non-limiting illustration of the partial cross-section of a shell mold 10 according to some embodiments described herein. (In this depiction, the wax pattern 12 has not been removed yet). The facecoat 14 is formed by depositing a series of layers, as shown. First layer 16 could be formed by dipping wax pattern 12 into a slurry comprising a composition similar to those described above, e.g., one based on fine particles of yttria and colloidal silica. The coated pattern is then usually drained. Layer 18 can comprise a coarser material or "stucco", e.g., yttria or yttrium silicate with a particle size greater than about 100 microns. The layer can be formed over layer 16 by various techniques. For example, the coated wax pattern can be placed in a rain machine with the coarse particles. The pattern is then usually air-dried. That sequence of steps could then be repeated to form layers 20 and 22, i.e., with layer 20 being similar in composition to layer 16, and layer 22 being similar to layer 18.

In this illustration, layers 16, 18, 20, and 22 constitute the facecoat. (Its relative thickness has been increased somewhat for the benefit of the visual depiction). As mentioned above, the facecoat can be heat-treated at this stage at a temperature high enough to remove all free silica. Alternatively, the facecoat can be heat treated (at this stage) at lower temperatures, e.g., to provide greater green strength.

A secondary layer set 24 is then formed over facecoat 14, to complete the mold, using the slurry compositions described herein. The layers in the secondary layer set can vary in composition, as discussed above. For example, layer 26 might comprise a yttria/alumina-based composition, with a yttria: alumina ratio of about 4:1. In layer 28, the ratio could be about 3:1; and the ratio in layer 30 could be about 2:1. Layers 32 and 34 might have ratios of about 1:1.

The outermost layers of the shell mold, e.g., layers 36, 38, 40, 42, and 44, are often (but not always) formed primarily of alumina. As described above, the higher alumina content in these layers can provide greater mold strength and high-temperature stability. However, many variations in the composition (and number) of these layers are possible, depending on mold requirements. For example, the outermost layers could contain substantial amounts of yttrium silicates or silica (which will be substantially converted to a silicate after the appropriate heat treatment). Similarly, many variations in the content of layers 26, 28, 30, 32 and 34 are possible.

Many variations in terms of compositional grading are possible. As but one example, U.S. Pat. No. 4,966,225 (Johnson et al) describes the use of variable layers in a multi-layer shell mold. (This patent is incorporated herein by reference). A variety of layer-sequences are illustrated, wherein the layers can differ from one another in terms of "thermophysical properties", i.e., the physical characteristics of a material at elevated temperatures. Examples of those properties are the coefficient of thermal expansion (CTE), thermal conductivity, and strength.

Other alternatives for the secondary layers are possible. As non-limiting examples, one or more of the secondary layers could individually comprise: (1) silica and yttria; (2) silica, alumina, and yttria; (3) silica and yttrium silicate (e.g., yttrium monosilicate); (4) silica, yttria, and yttrium silicate; or (5) silica, yttria, yttrium silicate, and alumina.

One or more cores (if needed) can be incorporated into the mold, in locations where cavities in the casting are to be ultimately formed. Standard techniques for incorporating the cores into the mold can be employed. For example, a core can be placed in a die, followed by the injection of wax around the core. The wax-core assembly can then be positioned within a desired location in the initial mold structure, which is then completed according to a process like that described above.

However, there are many variations to this technique. For example, a fully-formed core could be positioned within the shell mold after the mold has been fully completed. Other details regarding the formation and use of cores are known in the art. The mold cavity in which the core is disposed preferably has a facecoat, as described previously.

After the shell mold has been completed, the wax is removed by any conventional technique used in a lost wax process. As a non-limiting example, flash-dewaxing can be carried out by plunging the mold into a steam autoclave, operating at a temperature of about 100° C. to about 200° C. The autoclave is typically operated under steam pressure (about 90-120 psi), for about 10-20 minutes, although these conditions can vary considerably.

In some embodiments, the mold is then pre-fired. A typical pre-firing procedure involves heating the mold at about 800° C. to about 1150° C., for about 30 minutes to about 4 hours. The shell mold can then be fired according to conventional techniques. The required regimen of temperature and time for the primary firing stage will of course depend on factors such as wall thickness, mold composition, silicate particle size, and the like. The time/temperature regimen for firing should be one which is sufficient to convert substantially all free silica remaining in the mold to one or more of the metal silicates described previously, such as yttrium silicate. Typically, firing is carried out at a temperature in the range of about 1150° C. to about 1700° C., and more preferably, about 1200° C. to about 1400° C. The firing time can vary significantly, but is usually in the range of about 5 minutes to about 10 hours, and more often, about 1 hour to about 6 hours. In preferred embodiments, less than about 1% by weight free silica remains after this heat treatment, in either crystalline or non-crystalline (glass) form.

According to the casting process mentioned previously, molten niobium-silicide or other metals can immediately be poured into the shell mold at this time. Alternatively, the mold can be allowed to cool to room temperature. In that instance, the mold would then usually be pre-heated before the molten metal is introduced. Further steps which are conventional to mold fabrication may also be undertaken. Examples include techniques for repairing and smoothing the surfaces of the mold.

Various details regarding casting are well-known in the art. Non-limiting examples of casting techniques are described in the Subramanian et al patent mentioned above (U.S. Pat. No. 6,676,381). As the molten niobium-silicide or other alloy is poured into the mold, it contacts the inert facecoat of the mold (and the facecoat of the core, if present). As described above, the facecoat prevents any substantial reaction between the molten metal and the mold, thereby helping to ensure that the casting is defect-free. The effective use of the facecoat as such a barrier between a molten niobium-silicide casting material and a yttrium-silicate mold was confirmed. Other steps after casting are also known in the art. As an example, cores are removed from the casting by various techniques, e.g., autoclave leaching with a caustic solution.

The present invention has been disclosed in terms of various embodiments. However, the invention is not limited thereto, and is defined by the appended claims, as well as their equivalents. All of the patents, articles, and texts which are mentioned above are incorporated herein by reference.

What is claimed:

1. A shell mold for casting molten material to form an article, comprising:

(a) a shell for containing the molten material, comprising yttrium monosilicate and at least one compound selected from the group consisting of, zirconium silicates, hafnium silicates, rare earth silicates, other yttrium silicates, and combinations thereof; and (b) a facecoat disposed on an inner surface of the shell that contacts the molten material, said facecoat comprising at least one compound selected from the group consisting of yttrium silicates, zirconium silicates, hafnium silicates, rare earth silicates, and combinations thereof.

2. The shell mold of claim 1, wherein the yttrium silicate and the rare earth silicate each have a formula selected from the group consisting of (i) $R_2O_3SiO_2$;

(ii) $2R_2O_33SiO_2$;

(iii) $R_2O_32SiO_2$;

and combinations comprising at least two of the foregoing, wherein R is yttrium or at least one rare earth element.

3. The shell mold of claim 1, wherein the shell further comprises free yttria.

4. The shell mold of claim 1, wherein both the facecoat and the shell comprise yttrium monosilicate and free yttria.

5. The shell mold of claim 1, substantially free of non-bonded silica.

6. The shell mold of claim 1, wherein the shell comprises repeated layers applied over the facecoat, which also comprises repeated layers.

7. The shell mold of claim 6, wherein the repeated layers of the facecoat comprise yttrium silicate, free yttria, or a combination of yttrium silicate and free yttria.

8. The shell mold of claim 7, wherein at least a portion of the yttrium silicate in one or more of the facecoat layers comprises yttrium monosilicate.

9. The shell mold of claim 6, wherein the repeated layers of the shell comprise at least one of yttrium silicate and alumina.

10. The shell mold of claim 6, wherein the repeated layers of the shell are compositionally graded.

11. The shell mold of claim 10, wherein the repeated layers of the shell comprise yttria and alumina, and the total relative amount of yttria decreases, and the total relative amount of alumina increases, in at least some of the successive shell layers situated farther away from the facecoat.

12. The shell mold of claim 1, further comprising at least one core within a cavity of the mold, wherein the core is formed of a material selected from the group consisting of yttria, yttrium silicates, zirconium silicates, hafnium silicates, rare earth silicates, vitreous silica, alumina, aluminates, and combinations thereof.

13. The shell mold of claim 12, wherein the surface of the core is covered by a facecoat comprising at least one compound selected from the group consisting of yttria, yttrium silicates, zirconium silicates, hafnium silicates, rare earth silicates, and combinations thereof.

14. A method of casting a niobium-silicide article, comprising the step of introducing molten niobium-silicide into a cavity of a shell mold, and then allowing the molten material to cool and solidify, wherein the shell mold comprises:

(a) a shell for containing the molten material, comprising yttrium monosilicate and at least one compound selected from the group consisting of, zirconium silicates, hafnium silicates, rare earth silicates, other yttrium silicates, and combinations thereof; and (b) a facecoat disposed on an inner surface of the shell that contacts the molten material, said facecoat comprising at least one compound selected from the group consisting of yttrium silicates, zirconium silicates, hafnium silicates, rare earth silicates, and combinations thereof.

15. The method of claim 14, further comprising the step of incorporating at least one core into the cavity, wherein the core comprises at least one compound selected from the group consisting of yttrium silicates, zirconium silicates, hafnium silicates, rare earth silicates, and combinations thereof.

16. A method of making a ceramic shell mold for casting niobium-silicide-based articles, comprising the steps of:

(i) applying a facecoat-forming material to a wax pattern which has a configuration corresponding to a desired mold cavity, so as to form a facecoat, wherein the facecoat-forming material comprises at least one compound selected from the group consisting of yttria, zirconia, hafnia, rare earth compounds, and combinations thereof;

(ii) applying at least one aqueous slurry over the facecoat in successive layers until a mold having a mold wall of a desired thickness is obtained, wherein the aqueous slurry comprises colloidal silica and yttrium monosilicate; and then (iii) heat-treating the mold to remove substantially all free silica.

17. The method of claim 16, wherein the heat treatment of step (iii) is carried out under conditions sufficient to remove the free silica by conversion of the silica into one or more silicate compounds.

18. The method of claim 16, wherein the facecoat-forming material is applied to the wax pattern in the form of an aqueous slurry which comprises colloidal silica.

19. The method of claim 16, wherein step (ii) comprises the deposition of a ceramic stucco material between at least some of the successive layers of the aqueous slurry material.

20. The method of claim 19, wherein the ceramic stucco comprises particles of a material selected from the group consisting of yttrium silicates, zirconium silicates, hafnium silicates, rare earth silicates, and combinations thereof, and the average particle size is greater than about 50 microns.

21. A shell mold, comprising at least one mold cavity having a surface on which a facecoat is disposed; wherein the cavity is at least partially filled with molten niobium-silicide; and wherein:

(I) the material forming the shell comprises yttrium monosilicate and at least one compound selected from the group consisting of, zirconium silicates, hafnium silicates, rare earth silicates, other yttrium silicates. and combinations thereof; and (II) the material forming the facecoat comprises at least one compound selected from the group consisting of yttrium silicates, zirconium silicates, hafnium silicates, rare earth silicates, and combinations thereof.

22. The shell mold of claim 21, wherein at least one core is positioned within the mold cavity, and the surface of the core is covered by a facecoat comprising at least one compound selected from the group consisting of yttrium silicates, zirconium silicates, hafnium silicates, rare earth silicates, and combinations thereof.

23. A shell mold for casting molten material to form an article, comprising:

(a) a shell for containing the molten material, comprising at least one compound selected from the group consisting of yttrium silicates, zirconium silicates, hafnium silicates, rare earth silicates, and combinations thereof; and (b) a facecoat disposed on an inner surface of the shell that contacts the molten material, said facecoat comprising yttrium monosilicate and at least one compound selected from the group consisting of zirconium silicates, hafnium silicates, rare earth silicates, other yttrium silicates, and combinations thereof.

24. A shell mold for casting molten material to form an article, comprising:

(a) a shell for containing the molten material, comprising yttrium monosilicate; and (b) a facecoat disposed on an inner surface of the shell that contacts the molten material, said facecoat comprising at least one compound selected from the group consisting of yttrium silicates, zirconium silicates, hafnium silicates, rare earth silicates, and combinations thereof.

* * * * *